US007717925B2

(12) United States Patent
Hashiguchi et al.

(10) Patent No.: US 7,717,925 B2
(45) Date of Patent: May 18, 2010

(54) EPILATING APPARATUS

(75) Inventors: Tetsuro Hashiguchi, Hikone (JP); Hidekazu Sueyoshi, Higashiomi (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 1033 days.

(21) Appl. No.: 11/312,560

(22) Filed: Dec. 21, 2005

(65) Prior Publication Data

US 2006/0135965 A1 Jun. 22, 2006

(30) Foreign Application Priority Data

Dec. 22, 2004 (JP) ..... P2004-372336

(51) Int. Cl.
*A61B 17/50* (2006.01)

(52) U.S. Cl. ..... 606/133

(58) Field of Classification Search ..... 606/133, 606/131, 132, 134; 452/71; 8/161
See application file for complete search history.

(56) References Cited

U.S. PATENT DOCUMENTS

| | | | | |
|---|---|---|---|---|
| 6,176,862 | B1 | 1/2001 | Delay et al. | |
| 6,620,175 | B1 | 9/2003 | Sueyoshi et al. | |
| 2002/0065522 | A1 * | 5/2002 | Yamaguchi et al. | 606/133 |
| 2003/0009856 | A1 | 1/2003 | Inoue et al. | |
| 2005/0143755 | A1 | 6/2005 | Hashiguchi et al. | |
| 2005/0288687 | A1 | 12/2005 | Dorber et al. | |

FOREIGN PATENT DOCUMENTS

| | | |
|---|---|---|
| CN | 1155234 | 7/1997 |
| CN | 1239410 | 12/1999 |
| CN | 1387809 | 1/2003 |
| EP | 0569614 | 11/1993 |
| EP | 1262117 | 12/2004 |
| JP | 4-231908 | 8/1992 |
| JP | 6-105712 | 4/1994 |
| JP | 6-343777 | 12/1994 |
| JP | 2003-47521 | 2/2003 |
| JP | 2003-047521 | 2/2003 |
| JP | 2003-93142 | 4/2003 |
| JP | 2004-105639 | 4/2004 |
| WO | 03/079845 | 10/2003 |
| WO | 2004/054401 | 7/2004 |

OTHER PUBLICATIONS

English language Abstract of JP 2003-047521.
English language Abstract of de 4427788.

* cited by examiner

*Primary Examiner*—Anhtuan T Nguyen
*Assistant Examiner*—Thomas McEvoy
(74) *Attorney, Agent, or Firm*—Greenblum & Bernstein P.L.C.

(57) ABSTRACT

An epilating apparatus has a cylindrical rotating cylinder, a plate and driving portions. The cylindrical rotating cylinder has a plurality of claw portions for epilation. The plate has a plurality of openings, in which the plurality of claw portions are exposed, and covers the outside exposed surface of the rotating cylinder. The driving portions open-close drives the plurality of claw portions while rotationally drives the rotating cylinder so that hairs held by the claw portions are pulled out. The claw tip shape of each claw portion is formed in the shape of a circular arc having a center at the rotational center vicinity of the rotating cylinder.

1 Claim, 13 Drawing Sheets

EPILATING APPARATUS

CROSS REFERENCE TO RELATED APPLICATION

This application claims benefit of priority under 35 U.S.C. § 119 to Japanese Patent Application No. 2004-372336, filed on Dec. 22, 2004, the entire contents of which are incorporated by reference herein.

BACKGROUND OF THE INVENTION

1. Field of the Invention

The present invention relates to an epilating apparatus, and in particular, it relates to an epilating apparatus used to extract body hair for beautification and like.

2. Description of the Related Art

Heretofore, an epilating apparatus has been known, which has a plurality of claws for epilation that is open-close driven on a cylindrical rotating cylinder that is rotationally driven. This epilating apparatus nips hair by the claw portions provided on the rotating cylinder, and pulls out the nipped hair by the rotation of the rotating cylinder to perform an epilating process.

In the epilating apparatus, there has been a problem that the rotating cylinder and the claw portion are directly brought into contact with the skin, thereby harming the skin. To solve this problem, as shown in FIG. 1 or FIG. 2, an epilating apparatus is proposed which has a structure where a the skin protection plate 94 is provided so as to cover the outside exposed surface of a rotating cylinder 8, and a claw portion 5 comprising a movable claw 86 and a fixed claw 88 is exposed from a plurality of opening portions 94*a* formed in this plate 94 (for example, see Japanese Unexamined Patent Application Laid-open No. 2003-47521).

However, the epilating apparatus is devised such that the removable claw 86 nips the hair in a state inclined to the fixed claw 88, and hence, any of claw tip portions of the movable claw 86 and the fixed claw 88 which are portions to nip the hair is linearly formed. In contrast, since the skin protection plate 94 has a shape bent in a reverse U letter, as shown in FIG. 2, there develops a gap d between the claw tip portions of the movable claw 86 and the fixed claw 88 and the top portion of the plate 94. That is, while the epilating apparatus comprises the plate 94 so as to be able to protect the skin, since there exists the gap d between the plate 94 and the claw portion 5, it is difficult to nip a particularly short hair and perform epilating process, and further, even if it is a long hair, it is difficult to nip the hair from the root. Therefore, there is a problem that irritation during the epilating process becomes strong.

SUMMARY OF THE INVENTION

The present invention has been made in view of the above described problems, and an object of the invention is to provide an epilating apparatus, which has a skin protection plate so as to prevent a rotating cylinder and a claw portion from directly contacting the skin, and at the same time, a gap generated between the plate and the claw portion is eliminated so that an epilating process can be performed with high efficiency regardless of the length of the hair with little irritation and without harming the skin.

To achieve the object described above, there is provided an epilating apparatus comprising: a cylindrical rotating cylinder having a plurality of claw portions for epilation; a plate having a plurality of opening portions in which the plurality of claw portions are exposed, and covering an outside exposed surface of the rotating cylinder; and driving portions open-close driving the plurality of claw portions while rotationally driving the rotating cylinder so that hairs grasped by the plurality of claw portions are pulled out, wherein the claw tip shape of each claw portion is formed in the shape of a circular arc having a center at the vicinity of the rotational center of the rotating cylinder.

In such epilating apparatus, while preventing the rotating cylinder and the claw portion from directly contacting and harming the skin with the plate, the hair is guided from the opening portion provided in the plate, and at the claw portion, the epilating process can be performed. Further, since the opening portion peripheral edge of the plate operates so as to press the peripheral portion of the hair in the skin, thereby squeezing out the hair, it is possible to perform the epilating process with high efficiency. In addition, with the claw tip shape of the claw portion formed in the shape of an circular arc, a generation of gap is prevented between the claw portion and the plate, and therefore, an epilating process can be performed with high efficiency by nipping the hair from the root regardless of the length of the hair with few irritation and without harming the skin.

In the preferred embodiment according to the invention, the epilating apparatus is configured such that each claw portion provided in the rotating cylinder is formed by a pair of a fixed claw and a movable claw opposed in the direction of the rotating shaft of the rotating cylinder, and the rotating cylinder comprises a support point portion having a support point part of the open-close operation for the fixed claw of the movable claw and an open-close operating portion connected to the end portion of the movable claw and reciprocally driven in the direction to allow the movable claw to perform the open-close operation.

By configuring as described above, since a pitch of nipping the hair can be set small, even if it is a short hair, the hair can be reliably nipped at the hair root, and the epilating process can be performed with high efficiency and with little pain. Moreover, since the configuration capable of assuring such process is simple, it is easy to assemble and can be provided at low cost.

In the preferred embodiment according to the invention, the epilating apparatus is configured such that the support point part of the support point portion is provided at a position so that the movable claw when nipping the hair takes a posture in parallel with the fixed claw.

According to this configuration, even if both tip end shapes of the movable claw and the fixed claw are not made in the shape of a straight line, but in the shape of a circle arc, it is possible to nip the hair between both claws and perform the epilating process without any problem.

In the preferred embodiment according to the invention, the plate is curved along the outer peripheral surface in the rotational direction of the rotating cylinder.

By bending the plate in this manner, it is possible to pull out the hair introduced from the opening portion of the plate by rotational driving of the rotating cylinder and efficiently perform the epilating process, and at the same time, it is possible to conveniently perform the epilating process not only for a relatively flat and large region such as legs and arms, but also for a sunken region such as underarm.

In the preferred embodiment according to the invention, the plate is curved by a curvature radius of larger than the radius of the rotating cylinder.

In this manner, it is possible to perform an epilating process of a short hair with high efficiency by bringing the rotating cylinder and the claw portion internally touching with each other.

In the preferred embodiment according to the invention, the plate is elastically brought into contact with the rotating cylinder.

In this manner, it is further possible to perform an epilating process of a short hair with high efficiency.

BRIEF DESCRIPTION OF THE DRAWINGS

In the accompanying drawings:

FIGS. 3A and 3B are side sectional views of the epilating apparatus of an example of the present invention, in which FIG. 3A shows a whole epilating apparatus, and FIG. 3B shows an enlarged view of P portion of FIG. 3A;

DESCRIPTION OF THE PREFERRED EMBODIMENT

Figure 1:
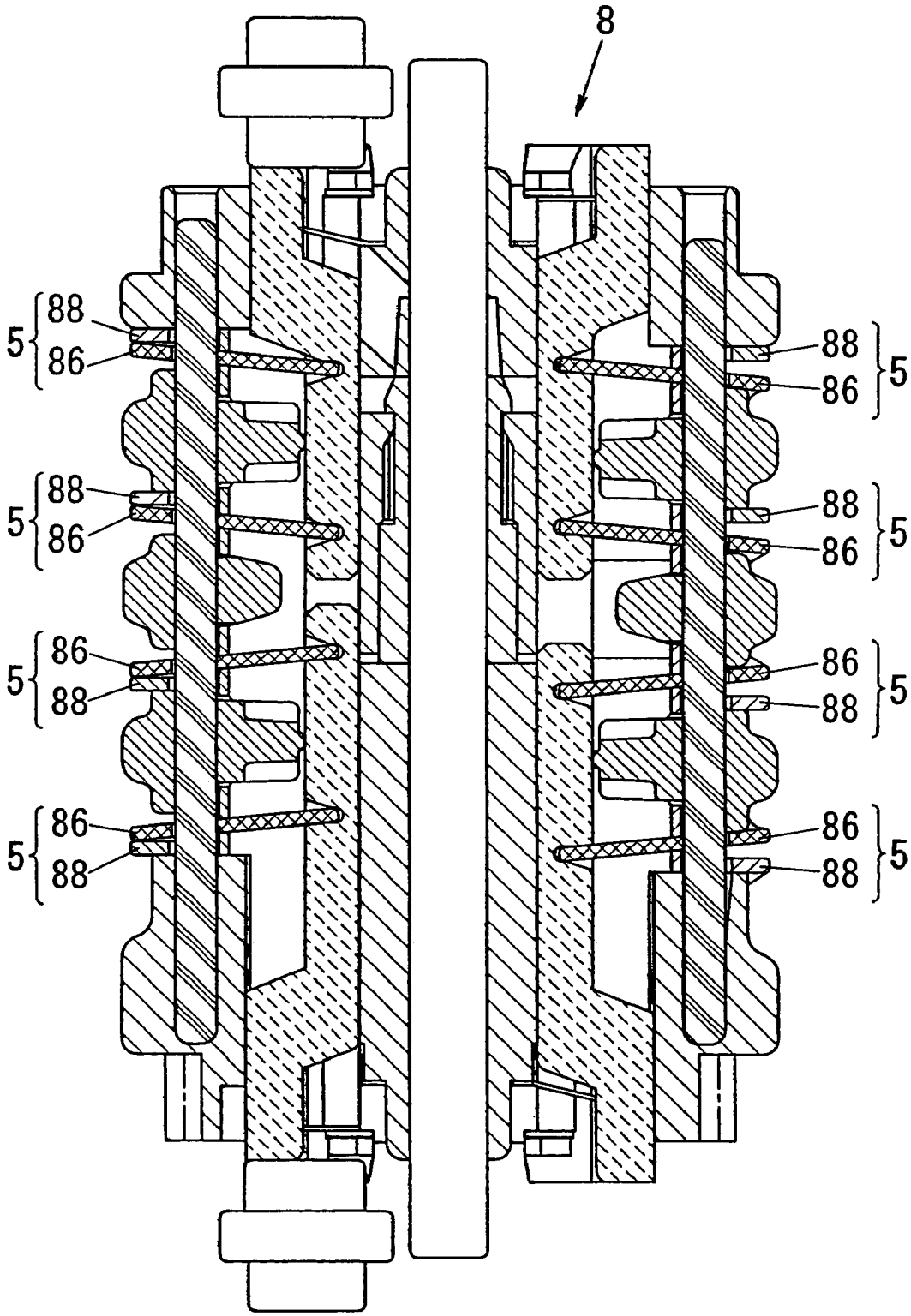
FIG.1 PRIOR ART
FIG. 1 is a front sectional view of a rotating cylinder of a conventional epilating apparatus.
Figure 2:
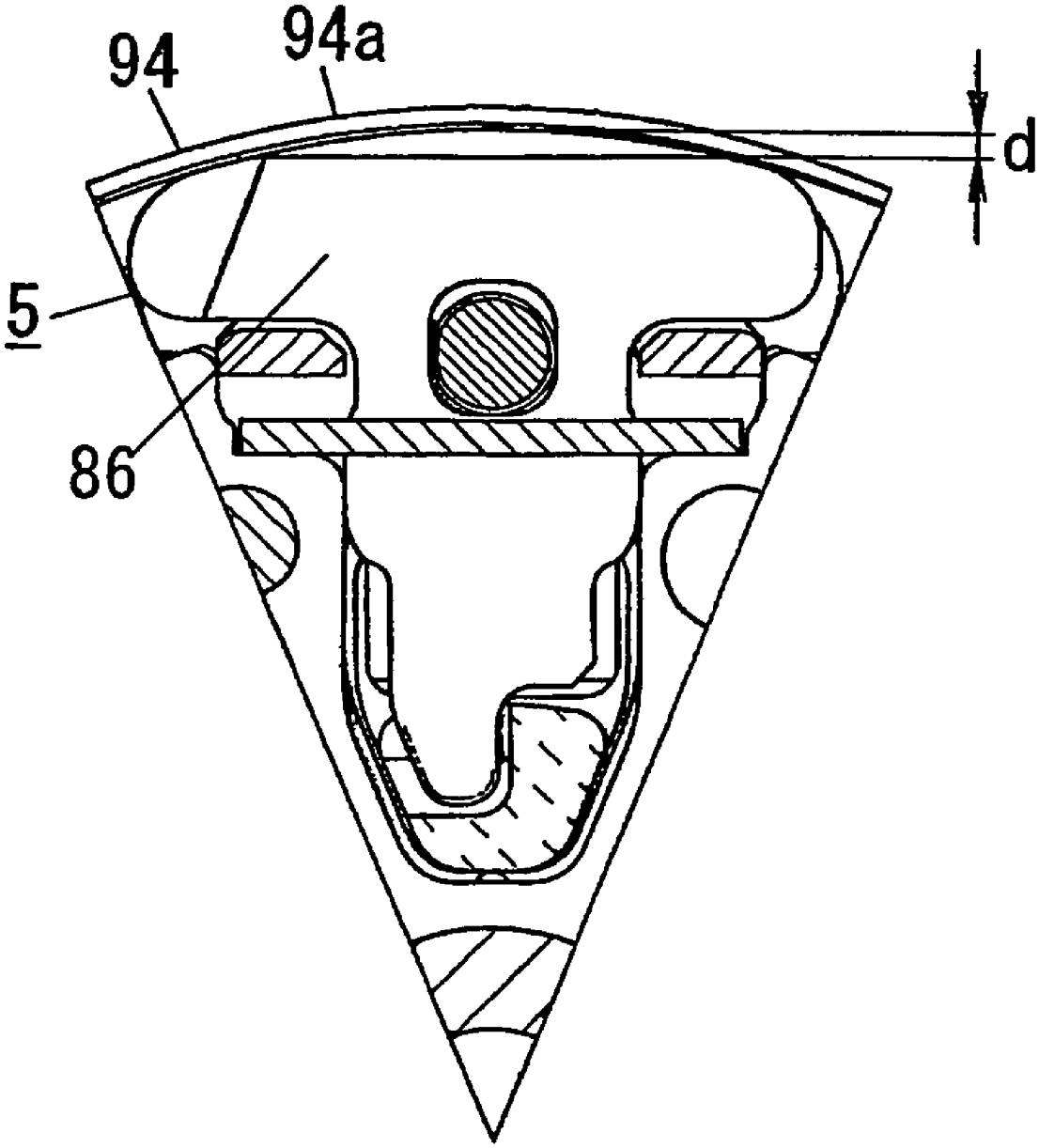
FIG.2 PRIOR ART
FIG. 2 is a main part side sectional view of the conventional epilating apparatus.
Figure 3A:
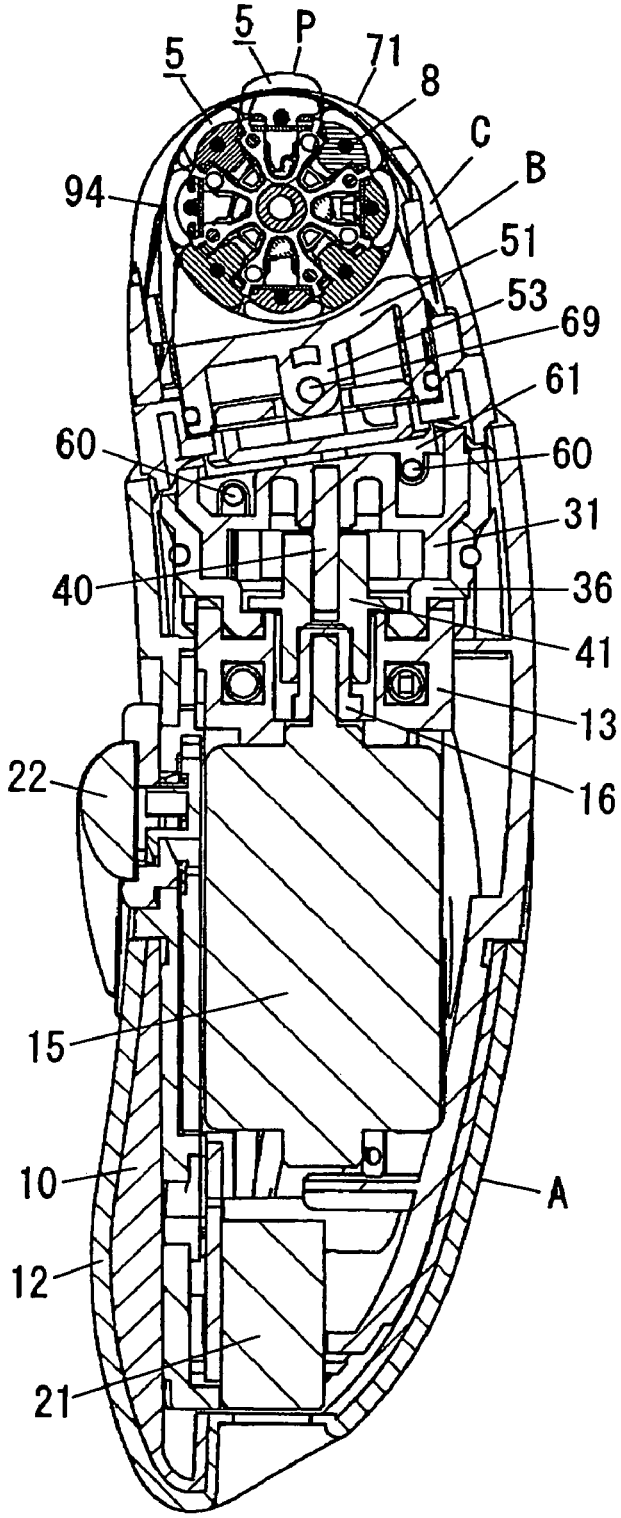
Figure 3B:
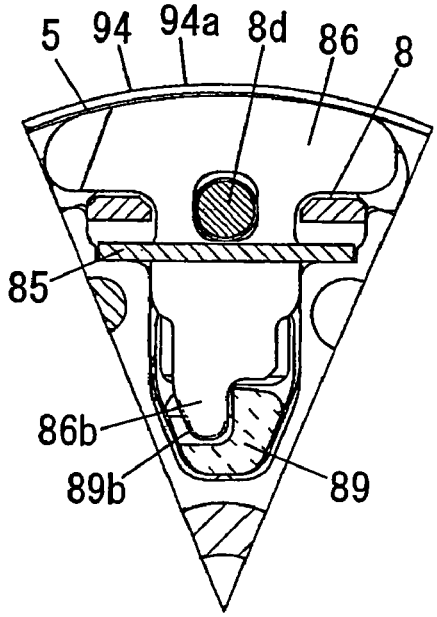

An embodiment of an epilating apparatus according to the present invention will be described below in detail based on the accompanying drawings.

The epilating apparatus of the present invention comprises a main body block A which is formed in a size graspable by a hand, having a built-in motor 15 which is a driving source, and an epilating head B comprising a rotating cylinder 8 provided detachably attachable to the main body block A. The rotating cylinder 8 is provided with epilating means configured by a plurality of claw portions 5 (that is, a pair of movable claw 86 and fixed claw 88 shown in FIG. 11) that is close-open driven and nips the hair, and the epilating means nips and pulls out the hair accompanied with the rotational driving around the shaft of the rotating cylinder 8.

Figure 9:
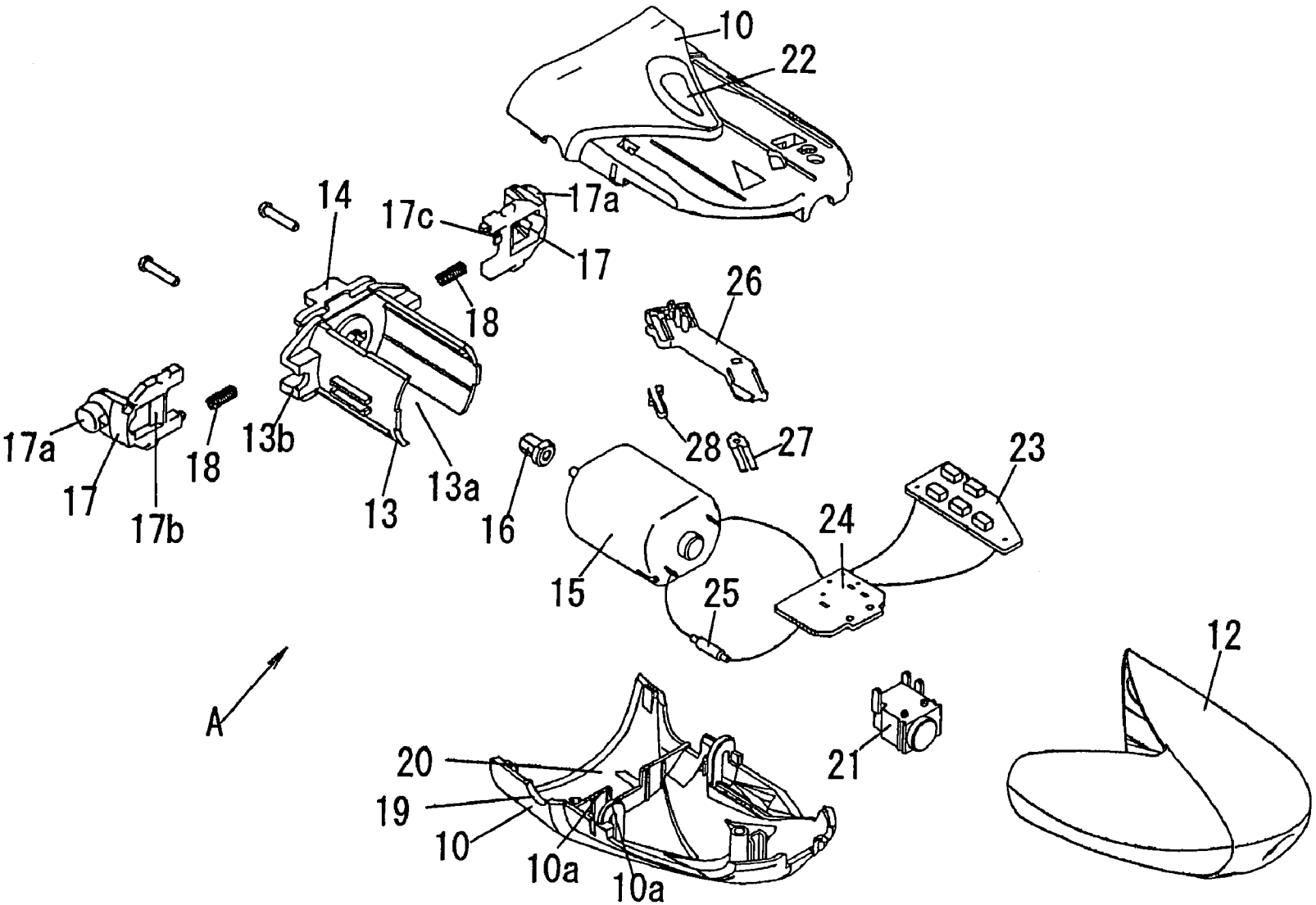
FIG. 9 is an exploded perspective view of the main body block.

The main body block A provided with a switch 22 in front, as shown in FIG. 9, has an outer shell configured by joining two half-casings 10 and 10 divided into back and forth with screws (not shown), and covering the half-casings 10 and 10 with a cover 12 to secure. The upper opening end thereof is closed by the upper surface portion of a motor case 13 to be described later, which is stored into the main body block A while holding a motor 15 and the like. The bottom of the main body block A is provided with a power supply jack 21. The main body block A may have a built-in battery which is a power supply. The front side half-casing 10 has the switch 22 exposable by popping up, and a switching equipment stored inside the main body block A is operated to turn ON and OFF the motor 15 through the switch 22. In FIG. 9, reference numeral 23 denotes a diode plate, reference numeral 24 a switch plate, reference numeral 25 a temperature fuse, reference numeral 26 a switch base, reference numeral 27 a switch clamp, and reference numeral 28 a click spring.

Figure 8:
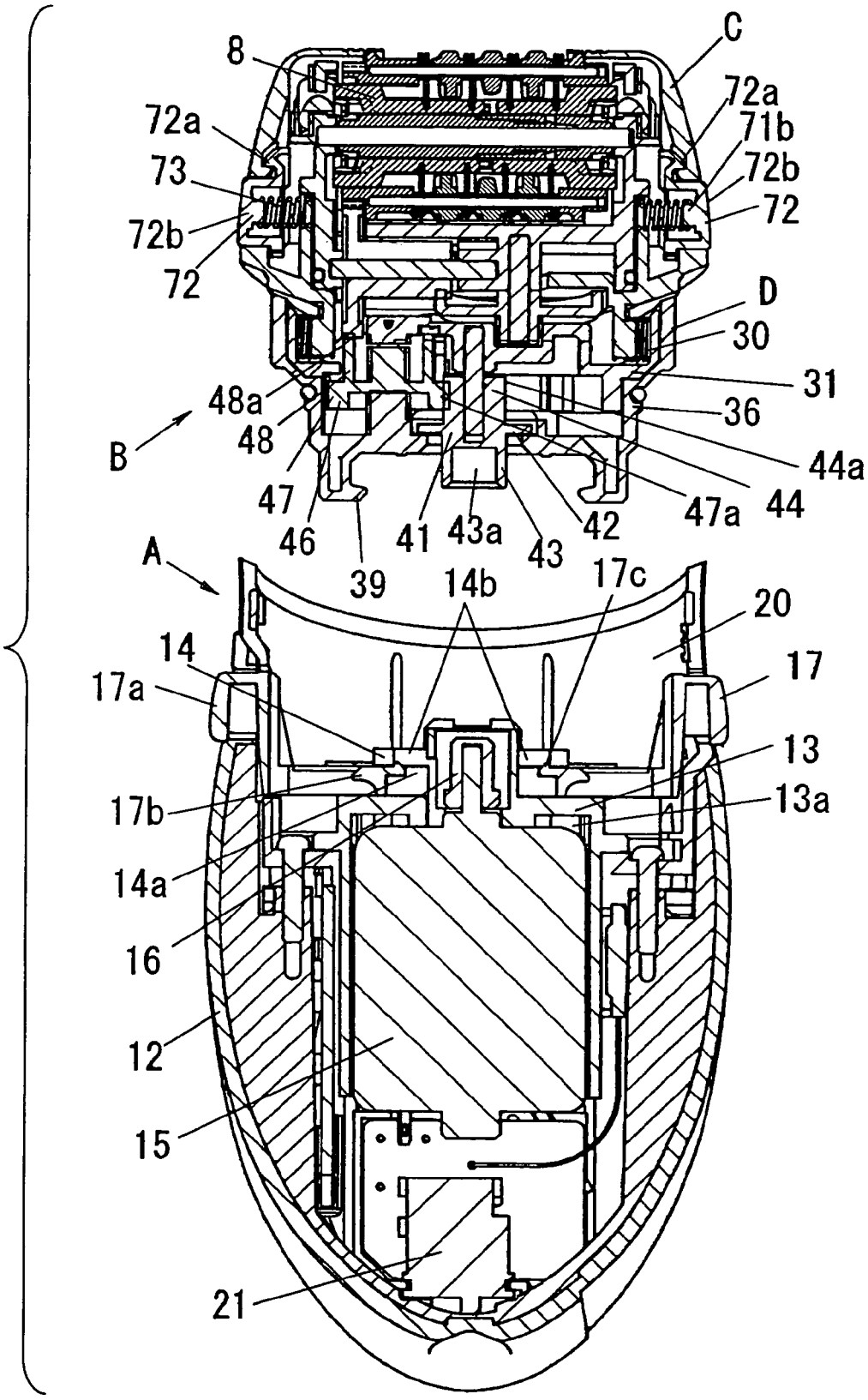
FIG. 8 is a front sectional view showing a state that an epilating head is taken out from a main body block.

The motor case 13 comprising a hook connecting portion 14 on the upper surface portion, as shown in FIG. 9, is shaped approximately like a horseshoe opening downward, and in a motor inner packaging portion 13*a* in its interior, the motor 15 is inserted from underneath. At the left and right sides of this motor case 13, there are provided rib portions 13*b*, which are fitted between protruding plates 10*a* protruding above and below the inner surfaces of both side end portions of the half casing 10, to be stored into the main body block A. The hook connecting portion 14 of the upper surface of the motor case 13, as shown in FIG. 8, is comprised of tunnel protruding portions 14*a* provided in the upper surface center portion of the motor case 13 and a pair of operating button frames 17 and 17 disposed at both the left and right sides of the tunnel protruding portions 14*a*. The upper surface portion of the tunnel protruding portions 14*a* having a tunnel passage is provided with holes 14*b* which are inserted up and down.

Each operating button frame 17 in the shape of an approximately oblong in plane view, as shown in FIGS. 9, 8 and the like, has a pushing operating portion 17*a* protruded outward in the lateral direction from its external side piece portion, a support hook 17*b* protruded in the internal surface of the internal side piece portion, and a stopper protruding portion 17*c* protruded upward above the internal side piece portion, and is slidably fitted into the tunnel passage of the tunnel protruding portion 14*a*, and at the same time, allows the stopper protruding portion 17*c* to slidably engage with the hole 14*b* so as to be mounted on the tunnel protruding portion 14*a*.

Between a pair of operating button frames 17 and 17 prevented from coming off by hitting upon the edge of the hole 14*b* through the stopper protruding portion 17*c*, holding springs 18 are provided in the tunnel passage, and by the holding springs 18, both of the operating button frames 17 and 17 are elastically biased to the outside. The pushing operating portions 17*a* of both of the operating button frames 17 and 17 are protruded to the outside of the main body block A through the holes 19 provided at the lateral sides (left and right directions) of the main body block A.

The epilating head B is comprised of an epilating block C comprising a rotating cylinder 8 serving as epilating means and a driving block D which transmits the output of the motor 15 of the main body block A to the rotating cylinder 8 of the epilating block C, as described below.

Figure 10:
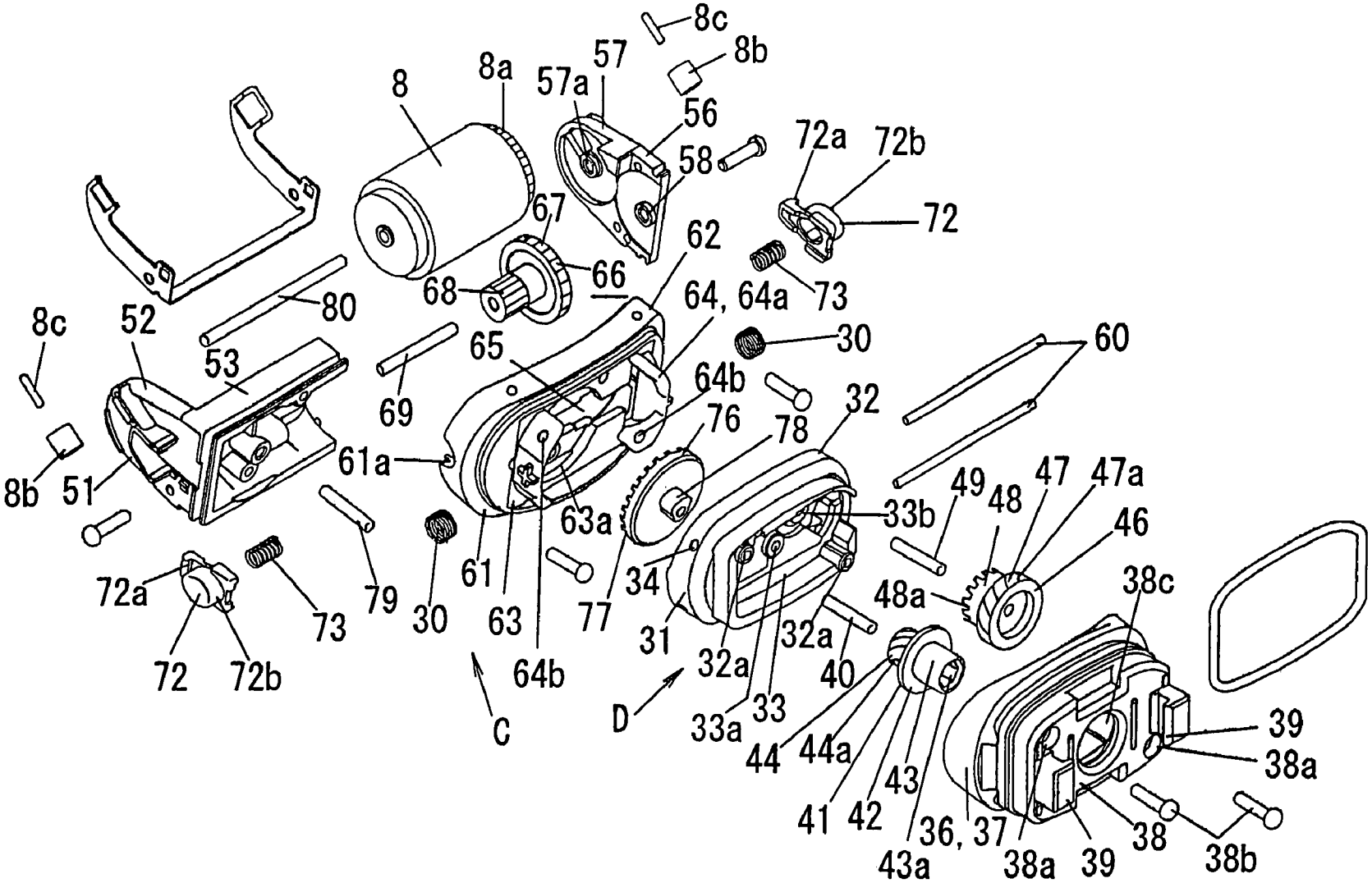
FIG. 10 is an exploded perspective view of the epilating head.

The driving block D, as shown in FIGS. 10 and 8, has its main body configured by a driving case 31 and a connecting case 36, a pinion coupling 41, a driving gear 46, and a eccentric cam 76. The driving case 31 and the connecting case 36 are stored into a storing concave portion 20 (see FIGS. 9 and 8) which opens at the upper end portion of the main body block A when the epilating head B is mounted on the main body block A, and its outer hull shape in plane view is slightly smaller than the outer hull shape of the main body block A. These driving case 31 and connecting case 36 are shaped so as to have plate portions 33 and 38 to partition an internal space in cylindrical side face portions 32 and 37, and the connection case 36 is provided in the lower side, while the driving case 31 is provided in the upper side. The driving case 31 and the connecting case 36 are fixed by inserting fixing screws 38*b* into screw inserting holes 38*a* of the connecting case 36 from beneath so as to be screwed to screw fixing holes 32*a* of the driving case 31. A pinion coupling 41 and a driving gear 46 are stored in the space inside the fixed driving case 31 and connecting case 36.

The pinion coupling 41, as shown in FIGS. 10 and 8, has a flange portion 42, above and below which a coupling connecting portion 43 and a gear portion 44 are formed respectively. The coupling connecting portion 43 is approximately shaped like a cylinder which protrudes downward from the flange portion 42, and has a concave portion 43*a* in its interior to be fitted with a pinion 16 that is fixed to the output shaft of the motor 15. When the epilating head B is amounted on the main body block A, the pinion 16 is fitted and connected to the concave portion 43*a*. Further, the gear portion 44 is shaped like a column or a cylinder protruding to upward from the flange portion 42, and its outer peripheral surface is formed to be a gear 44*a* to engage with the driving gear 46 to be described later. The driving gear 46 is composed of a gear portion 47 forming a gear 47*a* engaging with a gear 44*a* of the pinion coupling 41 on its outer peripheral surface and a face gear portion 48 provided with a face gear 48*a* on its upper end portion.

The storing of the pinion coupling 41 into the driving case 31 and the connecting case 36 will be described. The plate portion 38 of the connecting case 36 is formed with an inserting hole 38*c* (see FIG. 10) having approximately the same diameter as or slightly larger than the outer diameter of the gear portion 44 of the pinion coupling 41 and smaller than the flange portion 42. Further, the plate portion 33 of the driving case 31 is formed with a inserting hole 33*a* (see FIG. 10) which opens downward at a portion corresponding to the center of the inserting hole 38*c* in plan view. Further, the gear portion 44 of the upper side of the pinion coupling 41 is formed with a shaft inserting hole (not shown) which opens upward at its center, and the lower end portion of the pinion coupling support shaft 40 shown in FIGS. 10, 7 and the like is inserted into the shaft inserting hole of the pinion coupling 41, and at the same time, the upper end portion of the pinion coupling support shaft 40 is inserted into the shaft inserting hole 33*a* of the driving case 31, and the flange portion 42 of the pinion coupling 41 is mounted on the peripheral upper surface of the inserting hole 38*c* of the plate portion 38 of the connecting case 36 so as to allow the coupling connecting portion 43 of the pinion coupling 41 to protrude downward from the plate portion 38.

Next, the storing of the driving gear 46 into the driving case 31 and the connecting case 36 will be described. The plate portion 33 of the driving case 31 is formed with an inserting hole 33*b* having a diameter larger than that of the face gear portion 48 of the driving gear 46, and the plate portion 38 of the connecting case 36 is formed with a shaft inserting hole (not shown) which opens upward at a portion corresponding to the center of the inserting hole 38*c*. Further, the driving gear 46 is formed with a shaft inserting hole (not shown) in the center in plane view, and a driving gear support shaft 49 is inserted into the shaft inserting hole of the driving gear 46, and at the same time, the lower end portion of the driving gear support shaft 49 is inserted into the shaft inserting hole of the connecting case 36, and the upper end portion of the driving gear support shaft 49 is inserted into a base 61 to be described later. The face gear portion 48 of the driving gear 46 is put above the plate portion 33 of the driving case 31. At this time, the gear portion 47 of the driving gear 46 and the gear portion 44 of the pinion coupling 41 are put into an engaged state, and when the pinion 16 fixed to the output shaft of the motor 15 is rotated, the pinion coupling 41 connected to this pinion 16 and the driving gear 46 engaged with the pinion coupling 41 are rotated.

The epilating block C, as shown in FIGS. 10, 8, 7, 3A and the like, has its main body configured by a rotating cylinder 8, cylinder attachment bases 51 and 56 holding the rotating cylinder 8, and a base 61 to fix these cylinder bases 51 and 56. The base 61 is shaped approximately the same as the outer hull of the main body block A in its outer hull in plan view, and is shaped to have a plate portion 63 to partition an internal space in a cylindrical side face portion 62 having this outer hull shape, and is provided with a storing portion 63*a* of the eccentric cam 76 in the underside, which is stored between a driving block connecting portion 64 to be connected with the driving block D and the driving block D, and cylinder attachment bases 51 and 56 are fixed on the upper side. The driving block connecting portion 64 has protruding portions 64*a* directed downward respectively from both side portions of the base 61 so as to be placed in the inner wall of the cylindrical side face portion 32 of the driving case 31 of the driving block D with a gap. Both of these protruding portions 64*a* have inserting holes 64*b* to insert and erect two pieces of guide bars 60 at two places each, and guide bar inserting holes 34 to inserted the guide bars 60 are formed respectively at portions corresponding to the inserting holes 64*b* of the cylindrical side surface portion 32 of the driving case 31. The driving case 31 and the base 61 are connected by inserting two pieces of the guide bars 60 through the inserting holes 64*b* and the guide bar inserting holes 34. In this manner, since both protruding portions 64*a* of the base 61 are placed in the cylindrical side surface portion 32 of the driving case 31 with the gap, the base 61 can make a reciprocating motion with respect to the driving case 31 within the range of the gap. Further, between the base 61 and the driving case 31 connected in this manner, an eccentric cam 76 is stored, which allows the base 61 to make a reciprocating motion with respect to the driving case 31 as described above. This will be further described later.

The cylinder attachment bases 51 and 56 mounted on the upper side of the base 61, as shown in FIG. 10 and the like, have support side plates 52 and 57, respectively, which support a rotating shaft 80 of the rotating cylinder 8 at the left and right sides. Both of the cylinder attachment bases 51 and 56 are fixed to the base 61 respectively by fixing means (not shown) comprising screws. The center portions of the upper half portions of the support side plates 52 and 57 of both of the cylinder attachment bases 51 and 56 are provided with concave portions 57*a* to be engaged with the end portions of the rotating shaft 80 of the rotating cylinder 8, thereby supporting the rotating shaft 80 inserting through the center portion of the rotating cylinder 8 with both of the concave portions 57*a* so as to allow the rotating cylinder 8 to be rotatably driven. Further, the lower half portions of both cylinder attachment bases 51 and 56 are provided with concave portions 58, respectively, to be engaged with the end portions of a rotating shaft 69 of a connecting gear 66 to be described later, thereby supporting the rotating shaft 69 inserting through the center portion of the connecting gear 66 with both of concave portion 53 so as to allow the connecting gear 66 to be rotatably driven.

The connecting gear 66, as shown in FIG. 10 and the like, is formed with a large gear 67 having a large diameter and a small gear 68 having a small diameter. When the connecting gear 66 is rotatably provided on the cylinder attachment bases 51 and 56 and the base 61, a gear surface of the lower end portion of the large gear 67 of the connecting gear 66 is exposed downward through an inserting opening 65 formed in the plate portion 63 of the base 61, thereby engaging with the face gear portion 48 of the driving gear 46, which approaches above the driving block D. Further, the upper end portion of this large gear 67 is engaged with a gear portion 8*a* formed in the side end portion in the direction of the rotating shaft of the rotating cylinder 8, and the torque is transmitted to the pinion 16, the pinion coupling 41, the driving gear 46, the connecting gear 66, and the rotating cylinder 8 in that order by the rotation of the motor 15. Further, the torque is transmitted to the eccentric cam 76 as well from this connecting gear 66.

The eccentric cam 76, as shown in FIGS. 10, 8, 7, 3A and the like, is stored between the base 61 and the driving case 31, and is approximately shaped like a disc having a face gear 77 on its upper surface, and has a cam convex portion 78 protruded downward at a position decentered from the center of the outer hull circle of the disc main body. This eccentric cam 76 is fitted into the storing portion 63*a* (see FIG. 8) provided in the lower surface of the base 61, and allows a face gear 77 to approach upward through the inserting opening 65 formed in the plate portion 63 of the base 61, and is rotatably mounted with the rotating shaft 79 having its upper end portion fitted to the cylinder attachment base 51 through the inserting opening 65. This face gear 77 of the eccentric cam 76 engages with the small gear 68 of the connecting gear 66, and further, the cam convex portion 78 protruding downward is inserted into a long hole (not shown) provided on the upper surface of the plate portion 33 of the driving case 31. The long hole has a width (that is, the length in the left and right direction) approximately the same as the diameter of the cam convex portion 78, and its longitudinal side is formed longer than the diameter of the cam convex portion 78 in the direction orthogonal to the longitudinal direction (that is, the direction of the reciprocating motion of the base 61 and the driving case 31) of the guide bar 60. In this manner, when the connecting gear 66 rotates, the eccentric cam 76 is rotated, and the eccentric cam 76 rotates without changing the relative position to the base 61, and on the other hand, the cam convex portion 78 provided in the underside of the eccentric cam 76 makes an eccentric rotation relative to the base 61. The driving case 31, having the cam convex portion 78 inserted into its long hole, makes a reciprocating motion with the base 61 in the direction of the guide bar 60. Here, since the driving case 31 (that is, the driving block D) is fixed relative to the main body block A, the base 61 and the rotating cylinder 8 (that is, the epilating block C) make a relative reciprocating motion with the main body block A.

The springs 30 and 30 (see FIGS. 7, 8, 10, and the like) at both sides energizing the epilating block C, which periodically makes a reciprocating motion by the rotation of the eccentric cam 76, absorb an inertial force at the end point of the reciprocating motion, and prevent a collision so as to reduce the noises of collision sounds and the like.

Further, a head frame 71, which covers the cylinder attachment bases 51 and 56 and the rotating cylinder 8 is mounted at the upper side from the base 61 in the epilating block C. This will be described later.

In this manner, the epilating head B mounted with the epilating block C capable of flexibly making the reciprocating motion in the direction of the rotating shaft of the rotating cylinder 8 for the driving block D connects hooks 39 and 39 provided in the underside of the connecting case 36 to the hook connecting portion 14 of the main body block A, thereby being mounted on the main body block A (see FIGS. 8 to 10). When the epilating head B is mounted on the main body block A in this manner, the pinion 16 is engaged with the pinion coupling 41. In order to detach the epilating head B, one may press the pushing operating portions 17*a* so that the support hooks 17*b* can be removed from the hooks 39, and in this state, the epilating head B may be separated.

Next, the rotating cylinder 8 will be described. The rotating cylinder 8, as shown in FIGS. 11 and 12, is formed by connecting a pair of approximately cylindrical members 81 and 82 in the shaft direction, and its outer peripheral surface is provided with concave portions 83 at a plurality of places spaced at equal intervals in the peripheral direction (eight places at intervals of 45° in the illustrated example), and an epilating main body unit 84 is fitted into each concave portion 83.

Figure 11:
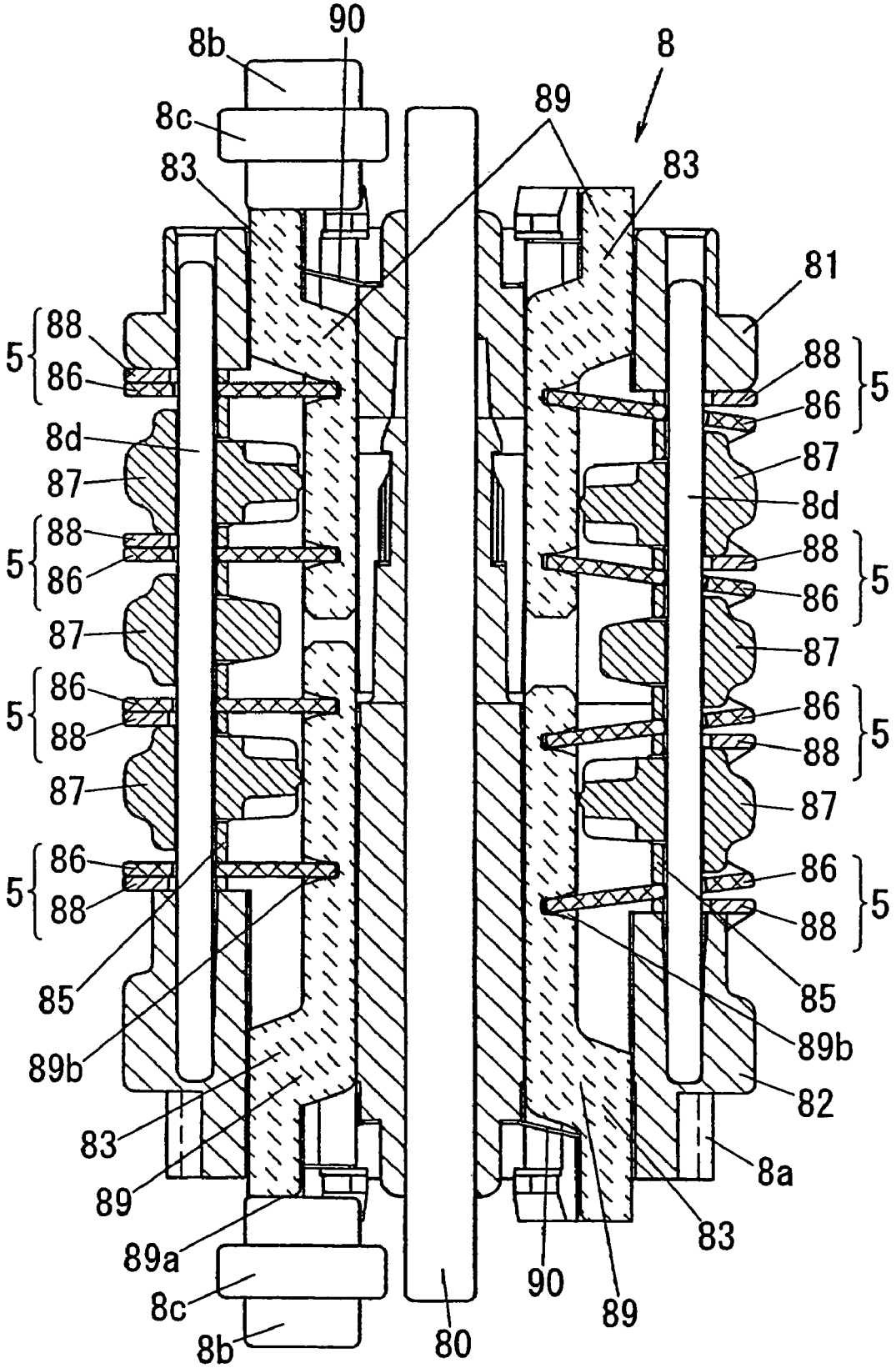
FIG. 11 is a front sectional view of the rotating cylinder.
Figure 12:
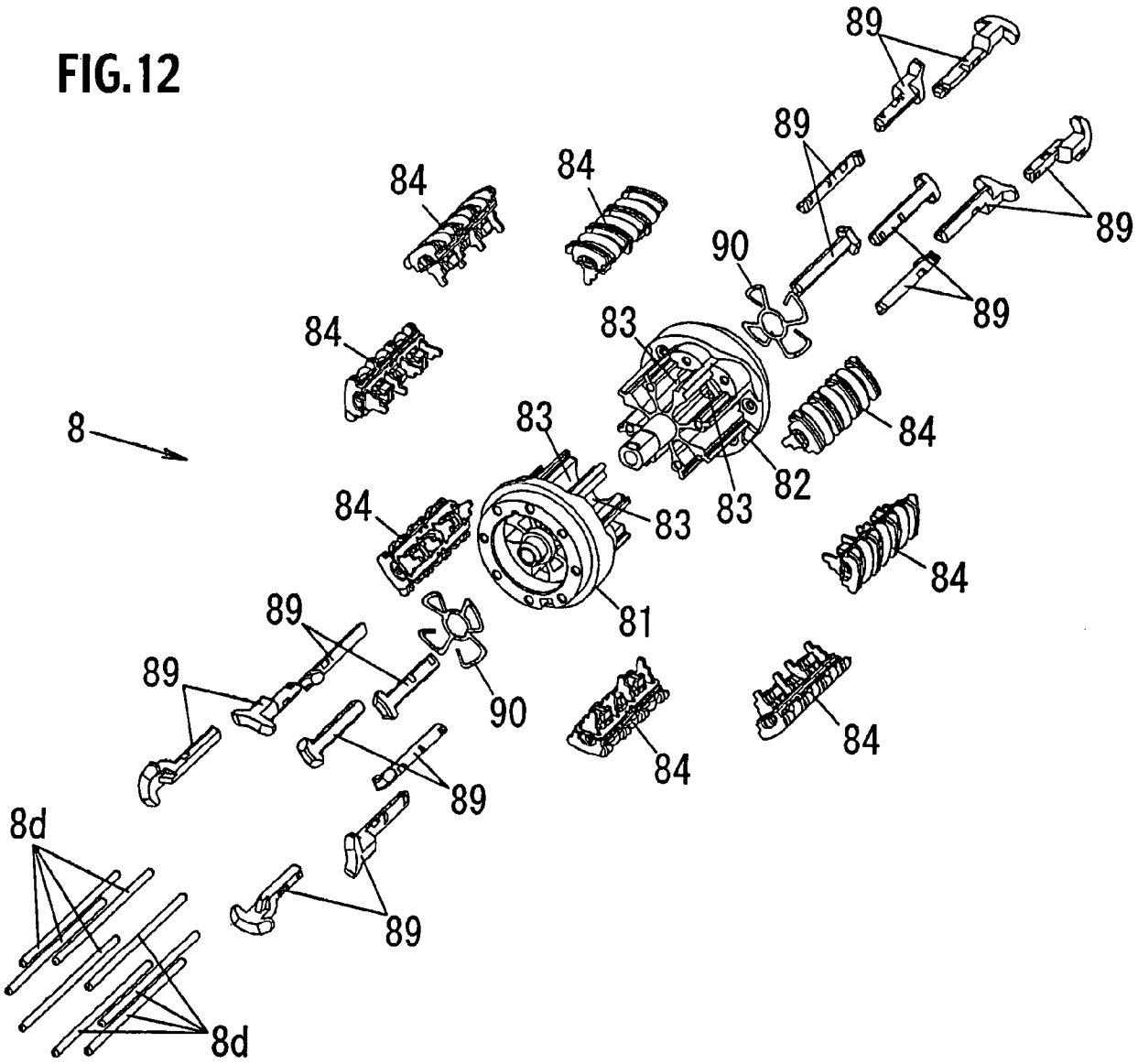
FIG. 12 is an exploded perspective view of the epilating main body unit.
Figure 13:
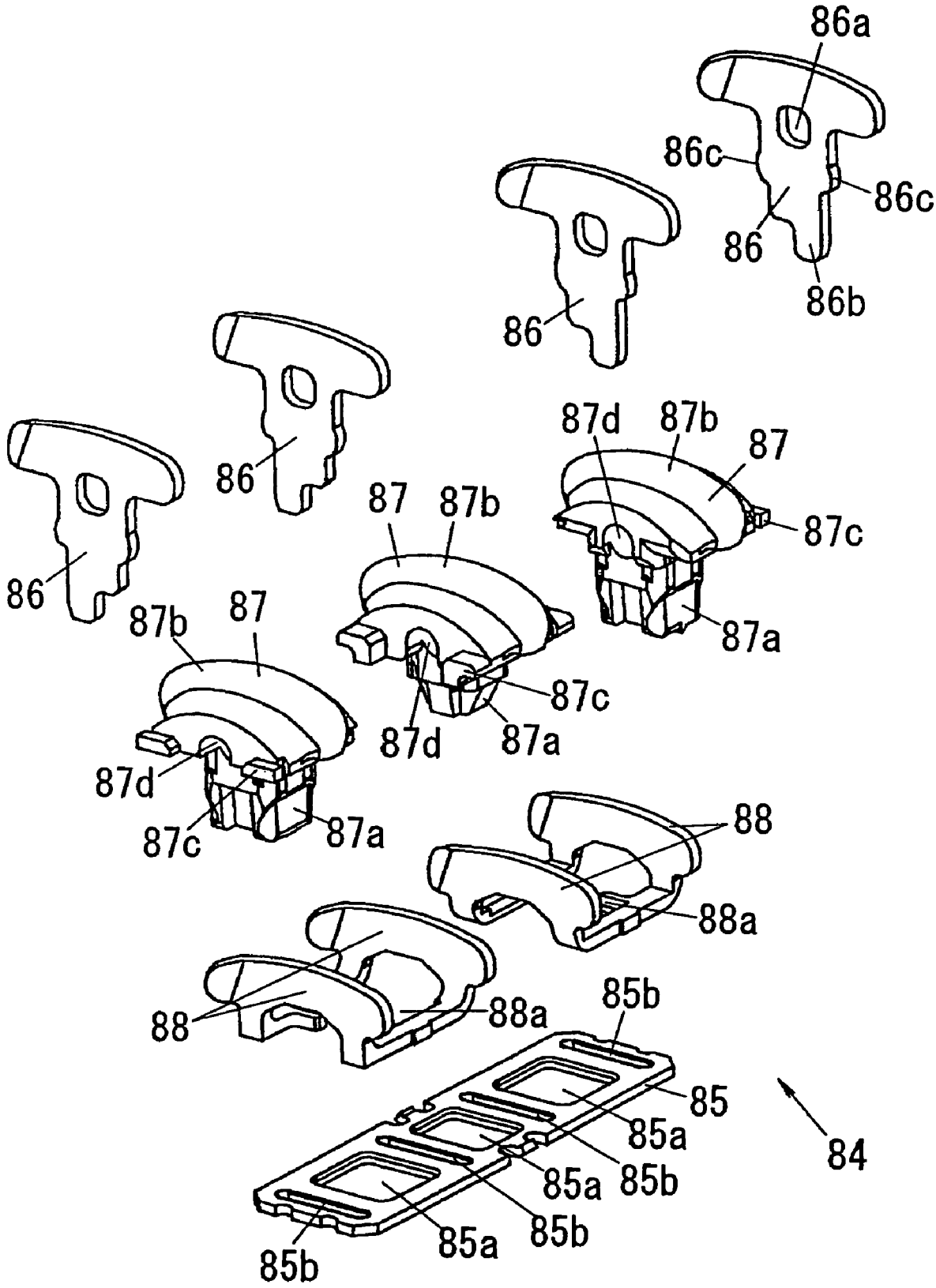
FIG. 13 is an exploded perspective view of the rotating cylinder.

The epilating main body unit 84, as shown in FIGS. 11 and 13, is composed of a support point portion 85 comprising a plate member; a plurality (four pieces in the illustrated example) of movable claws 86; support point stop members 87; and fixed claws 88, while two pieces of the fixed claw 88, as shown in FIG. 13, are integrally formed as a pair.

The support point portion 85 comprises square holes 85*a* to fit the support point stop member 87 and square holes 85*b* to fit the movable claw 86, and by press-fixing a protrusion 87*a* provided in the underside of the support point stop member 87 to the square hole 85*a* of the support point portion 85 through a hole 88*a* provided in the fixed claw 88, the fixing of the fixed claw 88 is also simultaneously performed. By making two pieces of the fixed claw 88 into a pair as described above, the assembly is simplified, and particularly in case plurality of the epilating main body unit 84 is disposed in the peripheral direction of the rotating cylinder 8, the length orthogonal to the rotating shaft 80 can be made small, and therefore, the outer diameter of the rotating cylinder 8 can be also made small.

Further, the upper surface portion 87*b* of the support point stop member 87 is shaped like a semi-circle in front section and side section, and plays a role of protecting the skin, thereby preventing the scraping of the skin and the like caused by direct contact with the skin of the movable claw 86 and the fixed claw 88.

The movable claw 86 allows the protruding portions 86*c* of both ends to engage with ribs 87*c* provided at both ends of the support stop member 87 so as to be built into the flank of the fixed claw 88 so as to oppose to the fixed claw 88 in the direction of the rotating shaft of the rotating cylinder 8. At this time, with respect to the fixed claw 88 integrally formed with two pieces as a pair, each one piece of the movable claw 86 is used independently, and for two pieces of the fixed claws 88 integrally formed, two pieces of the movable claws 86 are positioned in the hole 88*a* of the fixed claw 88 so as to be positioned at the same side for the corresponding fixed claw 88.

As described above, the epilating main body unit 84 assembled as one set of unit is mounted by inserting a shaft 8*d* (see FIG. 11), which is inserted into each concave portion 83 of one approximately cylindrical member 81, into a hole 87*d* of the support stop member 87 and a hole 86*a* of each movable claw 86 shown in FIG. 13, and fitting the top end portion of the shaft 8*d* into the concave portion 83 of the other approximately cylindrical member 81.

The fixed claws 88 of the epilating main body unit 84 are disposed at equal intervals in the shaft direction, and the gripping position when nipping the hair is well balanced, and therefore, the epilation efficiency is enhanced. Further, since the gripping position of each claw row provided in the peripheral direction is spaced at equal intervals, it is easy to pull out the targeted hair.

Further, an open-close operating portion 89 which is a lever member is inserted into each concave portion 83 formed in plurality in the peripheral direction of the rotating cylinder 8.

Each open-close operating portion 89, when the epilating main body unit 84 is mounted on the rotating cylinder 8, is formed with a groove 89*b* which is to be engaged with a protruding piece 86*b* of the movable claw 86, and the open-close operating portion 89 inserted into the concave portion 83 is provided so as to be connected with the protruding piece 86*b* of the movable claw 86. In this manner, by the reciprocating motion in the shaft direction of the open-close operating portion 89, two pairs of movable claws 86 for epilation can be allowed to simultaneously approach to and isolate from the fixed claw 88 (that is, to perform open and close operation), and therefore, the assembly can be easily performed by simple part configuration. Further, since a pitch of nipping the hair becomes small, even if it is a short hair, the hair root can be reliably nipped, and the epilating process can be performed with high efficiency and with little pain.

Between both end portions in the direction of the rotating shaft of the rotating cylinder 8 and pressing portions 89*a* formed in the outside end portions of the open-close operating portions 89, there are provided restoring springs 90 (see FIGS. 11 and 12) formed by the leaf springs. The restoring spring 90 biases the open-close operating portion 89 toward the outside in the direction of the rotating shaft of the rotating cylinder 8.

If a force to press the open-close operating portion 89 from outside is not operated from the outside, the movable claw 86 has its protruding piece 86*b* pulled out to the outside by the open-close operating portion 89, thereby swinging with a hole edge of a square hole 85*b* of the support point portion 85 as a support point part and separating from the fixed claw 88, which is positioned by the support point stop member 87. Further, if an external force is applied to the pressing portion 89*a* of the open-close operating portion 89 from the outside, the movable claw 86 has its protruding piece 86*b* pressed to the inner side by the open-close operating portion 89, thereby swinging with a hole edge of a square hole 85*b* of the support point portion 85 as a support point part so as to be pressed at the fixed claw 88. In this manner, the restoring spring 90 comprising a leaf spring is disposed in the end surface in the direction of the rotating shaft of the rotating cylinder 8, and all the open-close operating portions 89 are biased to the outside by the restoring spring 90, and therefore, a rotating cylinder 8 can be obtained at low cost which is easy to assemble.

While the claw tip shapes (that is, both of the claw tip shape of the movable claw 86 and the claw tip shape of the fixed claw 88) of the claw portion 5 are formed in the shape of a circular arc with a center at the vicinity of the rotational center of the rotating cylinder 8 so as to become a shape in imitation of the bent shape of the plate 94 to be described later, in the present embodiment, the posture of the movable claw 86 when nipping the hair becomes parallel with the fixed claw 88 so as to make a surface contact, thereby forming a hole edge of the square hole 85*b* of the support point portion 85. Therefore, it is possible to reliably nip the hair between the movable claw 86 and the fixed claw 88.

The rotating cylinder 8 thus formed is supported by the concave portions provided in the cylinder attachment bases 51 and 56 by both ends of the rotating shaft 80 inserted through the rotating cylinder 8, so that the rotation around the rotating cylinder shaft 80 is held in a flexible state.

In the epilating apparatus thus configured, when the motor 15 is driven in a state that the epilating head B is mounted on the main body block A, the rotating cylinder 8 is rotated as described above. When the rotating cylinder 8 is rotated, since the cams 8*b* are rotatably mounted on the cylinder attachment bases 51 and 56 with the cam shafts 8*c* (see FIG. 10), the open-close operating portions 89, which rotates to the position to contact the cams 8*b*, are pressed by the cams 8*b* so as to be pressed inward opposing to the restoring springs 90, thereby pressing the protruding piece 86*b* of the lower end portion of the movable claw 86 inward. The movable claw 86 having the lower end portion pressed inward and rotating with the support contact portion as a center is pushed against the corresponding fixed claw 88, respectively, and here, the hair introduced between the movable claw 86 and the fixed claw 88 is nipped in which state the rotating cylinder 8 is further rotated, so that the hair is pulled out. By the rotation of the rotating cylinder 8, the next open-close operating portions 89 reach the cams 8*b* and are pressed by the cams 8*b*, and the hair is similarly nipped and pulled out.

In addition, while the rotating cylinder 8 rotates and performs the epilation, the rotation is also transmitted to the gear wheel from the gear so as to rotate the eccentric cam 76, and due to this rotation, as described above, the epilating block C periodically makes a reciprocating motion with respect to the driving block D in the direction of the rotating shaft of the rotating cylinder 8. Due to this reciprocating motion, the hair nipping position by the fixed claw 88 and the movable claw 86 provided in the rotating cylinder 8 of the epilating block C changes, and therefore, the hair of the whole skin can be pulled out.

Figure 4:
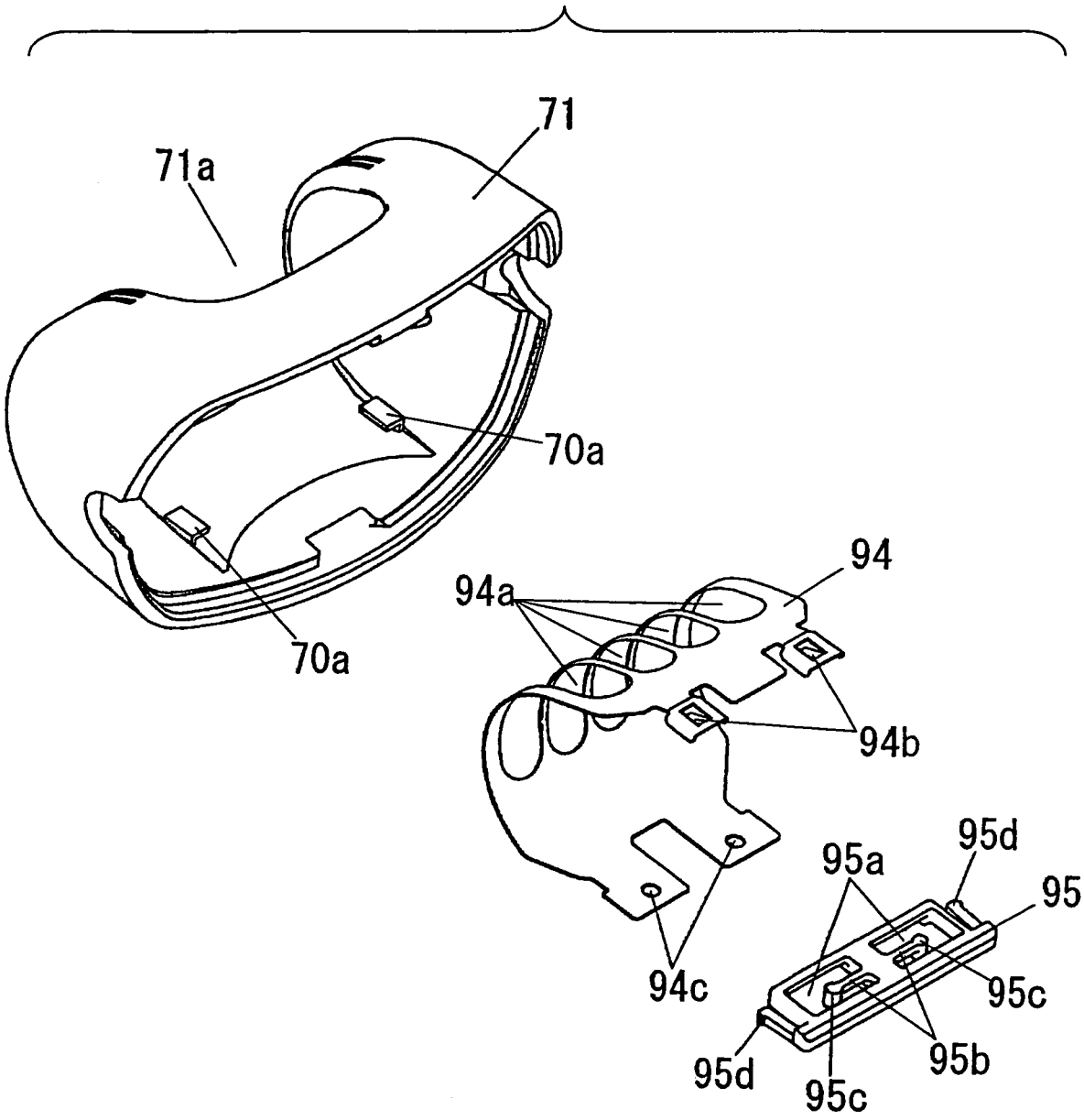
FIG. 4 is an exploded perspective view of a head frame of the epilating apparatus.
Figure 5A:
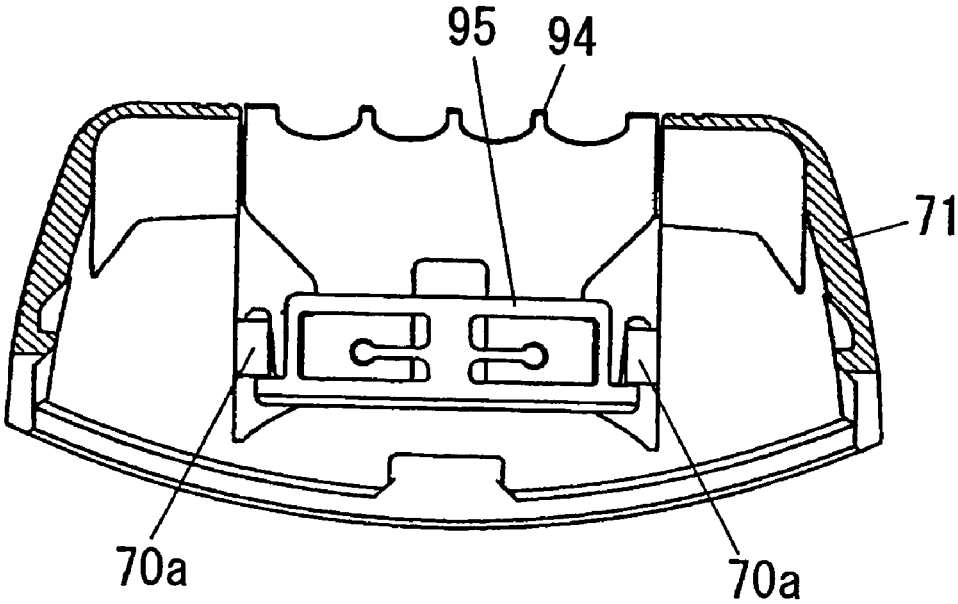
FIGS. 5A and 5B are assembly side sectional view of the head frame.
Figure 5B:
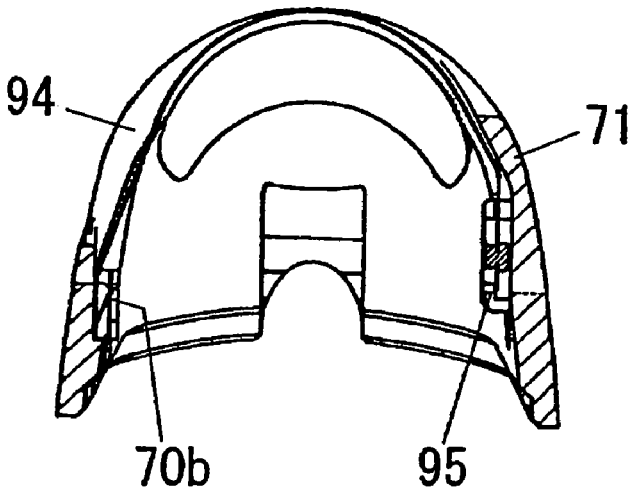
Figure 6:
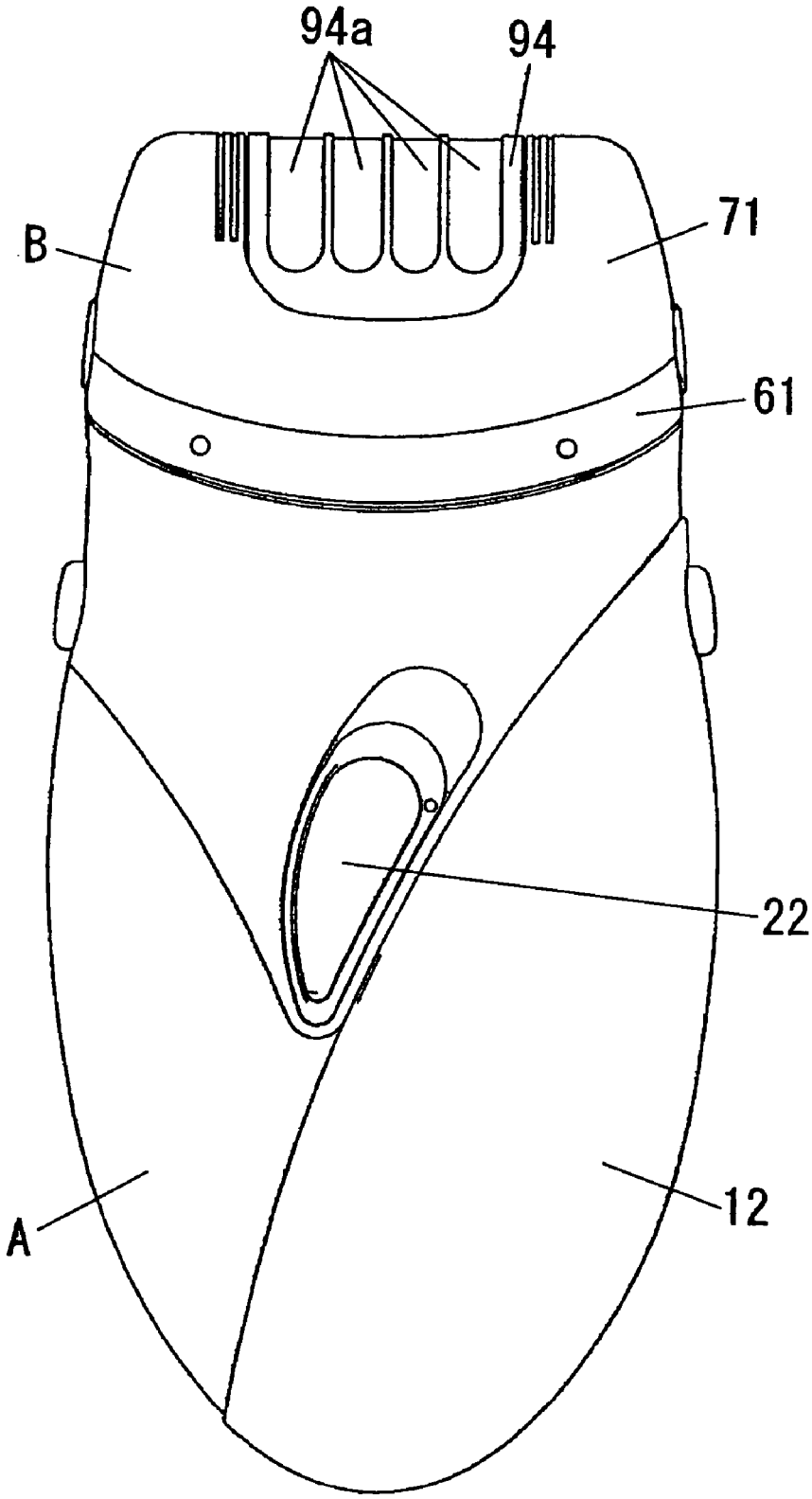
FIG. 6 is a front view of the epilating apparatus.
Figure 7:
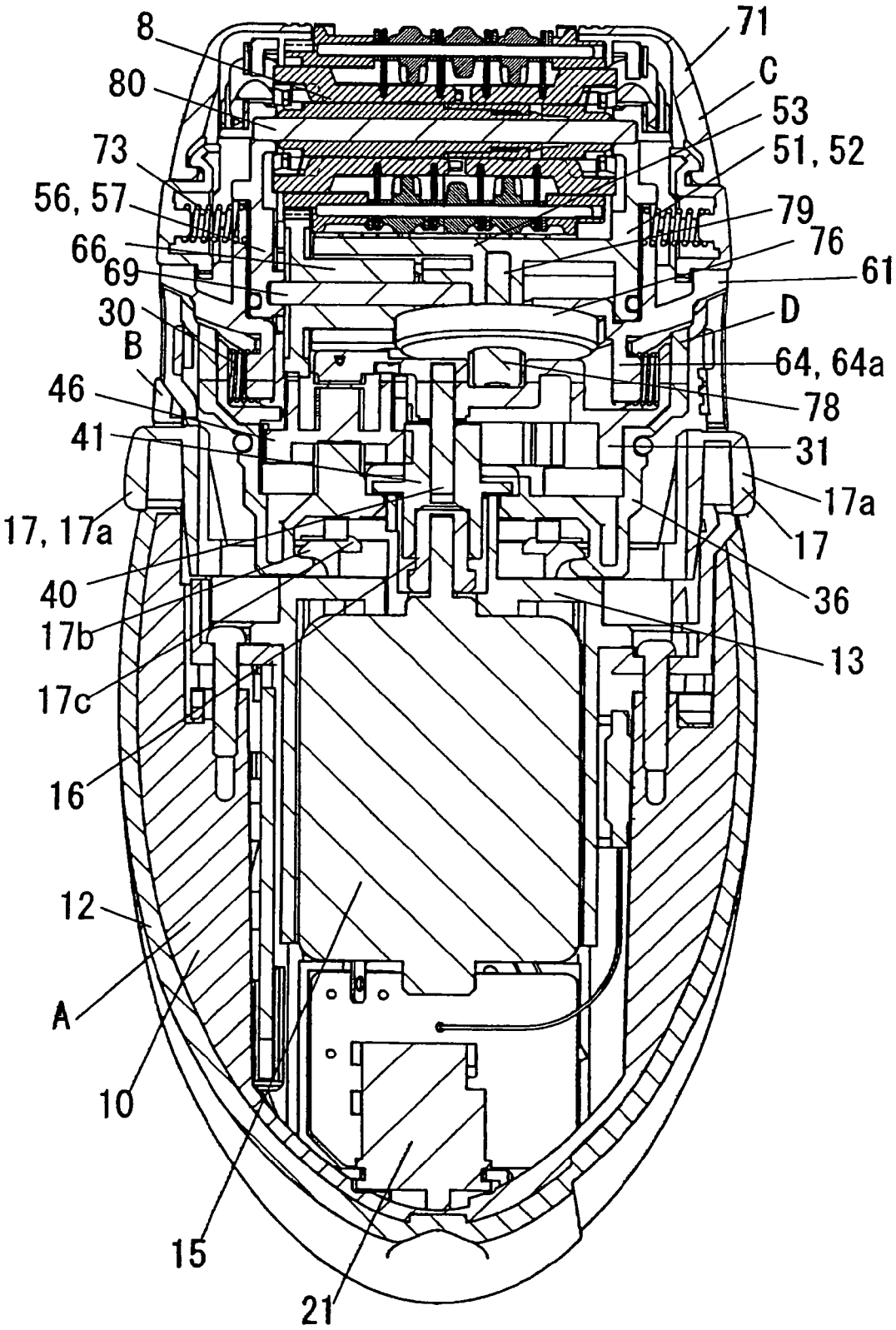
FIG. 7 is a front sectional view of the epilating apparatus.

Next, a head frame 71 provided in the epilating head B will be described. The head frame 71, as shown in FIGS. 4 to 6, has an approximately box-like outer shape which opens downward, and has an upper opening 71*a* in the upper end portion to expose the upper side of the rotating cylinder 8, and is detachably mounted on the base 61 of the epilating block C. With respect to the detachment and attachment of this head frame 71, as shown in FIGS. 10 and 8, the button portions 72 having engaging portions 72*a* are provided in the base 61 in a state that the dislocation is stopped so that the button portions 72 are poppably protruded to the outside from the inserting holes 61*a* (see FIG. 10) formed at the side portions of the base 61, and the engaging portions 72*a* of the button portions 72 are fitted to the lower end portion of the head frame 71, so that the head frame 71 can be detachably mounted. In FIGS. 7, 8, and 10, reference numeral 73 denotes a spring to restore the button portion 72.

The head frame 71 is provided with the plate 94 so as to cover the outer exposed surface of the rotating cylinder 8, which is exposed from the upper opening 71*a*. The plate 94 is curvedly shaped in an inverted U character so as to open downward in a side plane view (view in the direction of the rotating shaft of the rotating cylinder 8), and is curvedly shaped along the outer peripheral surface in the rotational direction of the rotating cylinder 8. A curvature radius of the plate 94 is set equal to or larger than that of the rotating cylinder 8 in order to allow the rotating cylinder 8 and the claw portion 5 to touch internally by elastic contact. The curved upper back portion of the plate 94 has a plurality of openings 94*a*, and the claw portions 5 (that is, the movable claw 86 and the fixed claw 88) of the rotating cylinder 8 exposed through the openings 94*a* nip the hair of the skin and pull out the hair. This plate 94 comprises a thin and high strength metal thin plate, and is mounted on the head frame 71 by a plate mounting base 95.

The plate mounting base 95, as shown in FIGS. 4 and 5, has the shape of a plate to be mounted on the underside interior of the upper opening 71*a* of the head frame 71, and is formed with openings 95*a* at the left and right sides, and at the same time, has elastic support pieces 95*b* protruded directing to both of the openings 95*a* from the center between the upper and lower portions of an approximately central vertical piece, and forms bosses 95*c* on the top end of the elastic support pieces 95*b*. This plate mounting base 95 has a mounting hook 95*d* formed respectively at both sides of the opening 95*a*, and ribs 70*a* in the shape of an approximately L character are provided at the portions corresponding to the mounting hooks 95*d* of the plate mounting base 95. Therefore, the plate mounting base 95 is fixed to the head frame 71 by mounting the mounting hooks 95*d* of the head frame 71 on the ribs 70*a*.

By fixing this plate mounting base 95 to the head frame 71 in a state that the plate 94 is mounted, one end portion of the plate 94 is fixed to the head frame 71. On the end portion of the side where the plate mounting base 95 of the plate 94 is mounted, there are formed boss fixing holes 94*c* at the positions corresponding to the bosses 95*c* of the plate mounting base 95, and the bosses 95*c* of the plate mounting base 95 are inserted into these boss fixing holes 94*c*, thereby being caulked and mounted there.

At the end portion in opposition to the side where the plate mounting base 95 of the plate 94 is mounted, there are formed fixing bent portions 94*b*, and at the same time, at the portions which correspond to the fixing bent portions 94*b* of the head frame 71, there are formed mounting square holes 70*b*, and the mounting square holes 70*b* are engaged and fixed with the fixing bent portions 94*b* of the plate 94, and the plate mounting base 95 mounted on the other end side of the plate 94 is mounted on the ribs 70*a* of the head frame 71, so that the mounting of the plate 94 to the head frame 71 is performed.

In this manner, by mounting the plate 94 having the opening portions 94*a* to expose the claw portion 5 on the head frame 71, it is possible to pull out the hair while protecting the skin. A plurality of claw portions 5 provided in the rotating cylinder 8 are disposed in the rotational direction of the rotating cylinder 8 spaced at equal intervals, and the open-close operation of the claw portion 5 is set to be performed one or plural times in the opening portions 94*a* of the plate 94 during one rotation of the rotating cylinder 8, and therefore, the epilating process can be efficiently performed due to the open-close operation of the claw portions 5 exposed from the opening portion 94*a*.

Further, since the plate 94 is mounted on the elastic support pieces 95*b* of the plate mounting base 95, the plate 94 is flexibly floated for the head frame 71 and the rotating cylinder 8, and consequently, when the plate 94 is mounted so as to perform the epilation, a skin contact is good even at an uneven region of the skin, and usability is good.

Any of the plurality of opening portions 94*a* provided in the plate 94 is formed in a long hole which becomes broader in width in the rotational direction of the rotating cylinder 8 than the width thereof in the direction of the rotating shaft. Further, since each opening portion 94*a* being the long hole is formed in parallel with the rotational direction of the rotating cylinder 8, the long hair can be efficiently introduced into the opening portions 94*a*. Moreover, the opening edges of the opening portions 94*a* are operated so as to press the skin and squeeze out the hair, and consequently, the short hair can be also efficiently processed for extraction.

In addition, since the widths of the crosspieces formed between the opening portions 94*a* of the plate 94 are formed smaller than the widths of the opening portions 94*a* in the direction of the rotating shaft of the rotating cylinder 8, it is prevented that the long hairs are laid down on the crosspieces of the plate 94 and are hindered from being introduced, and consequently, regardless of the length of the hair, the extraction of the hair can be efficiently performed.

What is claimed is:

1. An epilating apparatus comprising:

a cylindrical rotating cylinder having a plurality of claw portions for epilation;

a plate having a plurality of opening portions in which the plurality of claw portions are exposed, and covering an outside exposed surface of the rotating cylinder; and driving portions for open-close driving the plurality of claw portions while rotationally driving the rotating cylinder so that hairs grasped by the plurality of claw portions are pulled out, wherein each claw portion provided in the rotating cylinder comprises a fixed claw fixed to the rotating cylinder and a movable claw opposed in the longitudinal direction of the rotating shaft of the rotating cylinder to the fixed claw, the movable claw is swingably supported by a support point part provided in the rotating cylinder, such that the movable claw is swingable about the support point part between an open position where the movable claw is inclined relative to the fixed claw with a tip end of the movable claw being spaced from a tip end of the fixed claw, and a closed position where the movable claw is substantially parallel with the fixed claw with the tip end of the movable claw being in surface contact with the tip end of the fixed claw for nipping the hair, and the tip ends of the fixed claw and the movable claw are in a shape of a circular arc having a center at the vicinity of the rotational center of the rotating cylinder;

a head frame having an approximately box-like outer shape which opens downward and having an upper opening in an upper end portion, L-shaped ribs, and square mounting holes;

boss fixing holes provided on the plate;

fixing bent portions provided on the plate to be engaged with the square mounting holes of the head frame; and a plate mounting base having the shape of a plate with openings at the left and right sides thereof, having elastic support pieces protruding toward both of the openings from the center between the upper and lower portions of an approximately central vertical piece with bosses on the top thereof which are inserted into the boss fixing holes of the plate, and having mounting hooks formed respectively at both sides of the openings and mounted on the L-shaped ribs of the head frame.

* * * * *

UNITED STATES PATENT AND TRADEMARK OFFICE

CERTIFICATE OF CORRECTION

PATENT NO. : 7,717,925 B2
APPLICATION NO. : 11/312560
DATED : May 18, 2010
INVENTOR(S) : T. Hashiguchi et al.

It is certified that error appears in the above-identified patent and that said Letters Patent is hereby corrected as shown below:

On The Title Page, Item (56), Foreign Patent Documents, delete "JP 2003-47521".

Signed and Sealed this

Twenty-first Day of December, 2010

David J. Kappos

David J. Kappos
*Director of the United States Patent and Trademark Office*